US008103039B2

(12) United States Patent
van Halteren et al.

(10) Patent No.: US 8,103,039 B2
(45) Date of Patent: Jan. 24, 2012

(54) MICROPHONE ASSEMBLY WITH A REPLACEABLE PART

(75) Inventors: Aart Zeger van Halteren, Hobrede (NL); Paul Christiaan van Hal, Amsterdam (NL)

(73) Assignee: Sonion Nederland B.V., Amsterdam (NL)

( * ) Notice: Subject to any disclaimer, the term of this patent is extended or adjusted under 35 U.S.C. 154(b) by 785 days.

(21) Appl. No.: 12/241,888

(22) Filed: Sep. 30, 2008

(65) Prior Publication Data

US 2009/0087009 A1 Apr. 2, 2009

Related U.S. Application Data

(60) Provisional application No. 60/997,114, filed on Oct. 1, 2007.

(51) Int. Cl.
*H04R 25/00* (2006.01)

(52) U.S. Cl. ..... 381/355; 381/174; 381/361

(58) Field of Classification Search ..... 381/113, 381/114, 355, 361, 365, 368, 173, 174, 191; 439/63, 66, 86, 91
See application file for complete search history.

(56) References Cited

U.S. PATENT DOCUMENTS

| | | | | |
|---|---|---|---|---|
| 3,816,671 | A | 6/1974 | Fraim et al. | 179/111 |
| 4,221,444 | A | 9/1980 | Patrick | 339/17 M |
| 4,281,222 | A * | 7/1981 | Nakagawa et al. | 381/357 |
| 5,788,516 | A * | 8/1998 | Uggmark | 439/86 |
| 6,307,946 | B1 * | 10/2001 | Fujimoto et al. | 381/355 |
| 6,366,678 | B1 | 4/2002 | Madaffari et al. | 381/324 |
| 6,824,394 | B1 | 11/2004 | Brundage | 439/65 |

FOREIGN PATENT DOCUMENTS

| | | |
|---|---|---|
| EP | 0 888 031 A1 | 12/1998 |
| WO | WO 00/41432 | 7/2000 |
| WO | WO 00/74437 A1 | 12/2000 |

OTHER PUBLICATIONS

European Search Report for Application No. EP 08 16 5398 date Oct. 5, 2009 (6 pages).

* cited by examiner

*Primary Examiner* — Huyen D Le
(74) *Attorney, Agent, or Firm* — Nixon Peabody LLP

(57) ABSTRACT

The invention relates to a microphone assembly comprising a housing, a microphone element within the housing, a base element, contacting elements, a removable element, and connecting means. The housing is configured such that it may be opened and re-closed. The base element is positioned inside the housing and comprises one or more first electrical conductors. The base element comprises one or more first conducting surface parts connected to one or more of the first conductors. The contacting elements facilitate electrical contact between one or more of the first conductors and one or more conductors positioned outside the housing. The removable element is positioned within the housing and comprises one or more second electrically conductive surface parts. The connecting means provides an easily breakable/removable electrical connection between a first surface part and a second surface part.

7 Claims, 2 Drawing Sheets

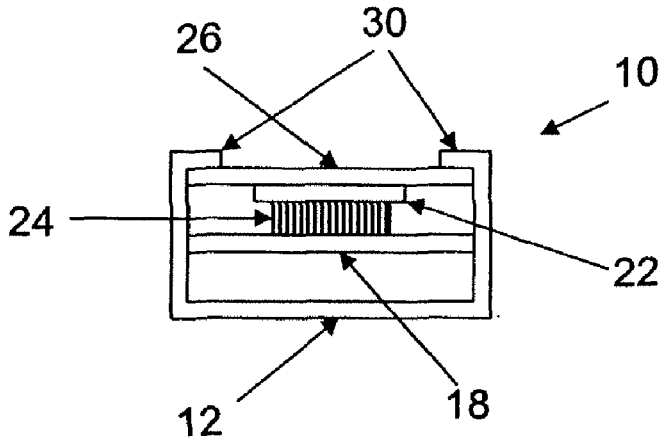
Figure 5
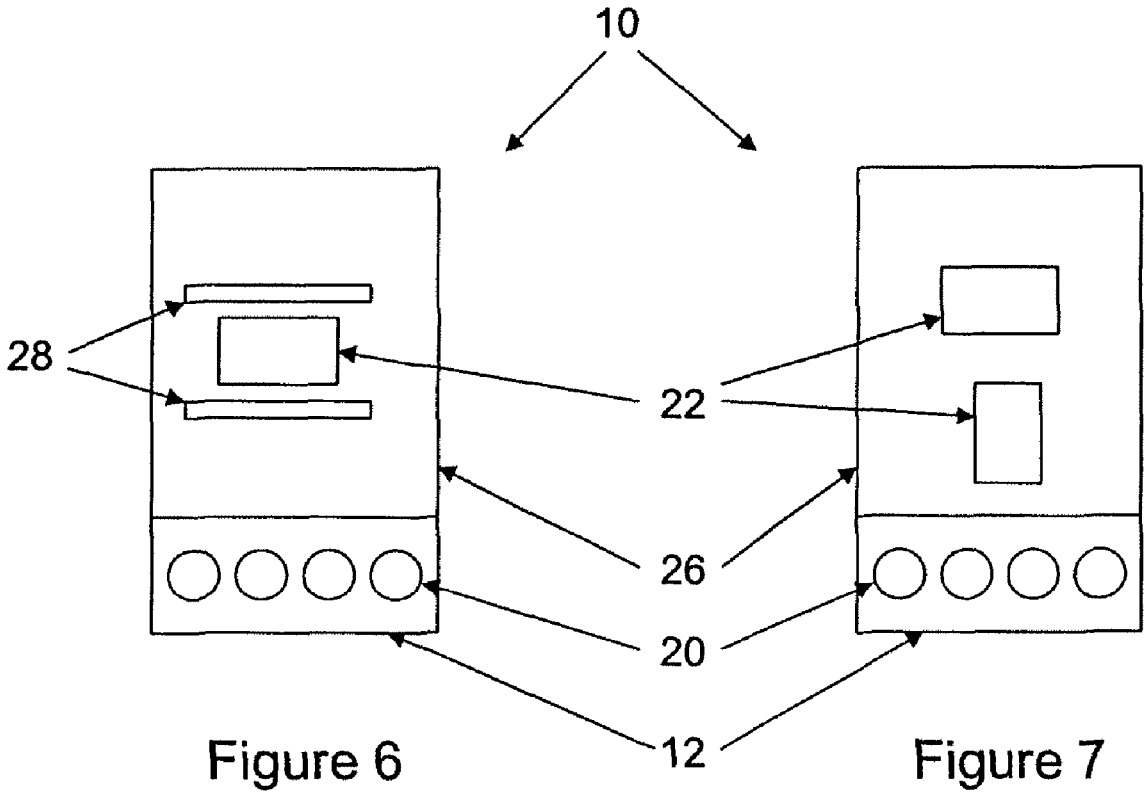
Figure 6
Figure 7

MICROPHONE ASSEMBLY WITH A REPLACEABLE PART

CROSS-REFERENCE TO RELATED APPLICATION

This application claims the benefit of U.S. Provisional Application Ser. No. 60/997,114, filed on Oct. 1, 2007, which is hereby incorporated by reference in its entirety.

FIELD OF THE INVENTION

The present invention relates to a microphone assembly with a replaceable or removable part positioned inside the housing.

BACKGROUND OF THE INVENTION

Today, it is more and more common to combine standard microphones, such as for use in hearing aids, in-ear monitors and the like, with additional functionality, such as amplifiers, sensors, DSP's or the like. This, however, brings about the problem that malfunction of one of the microphone component and the chip(s) incorporating the added functionality will make the assembly useless. The present invention aims at solving this problem.

Prior art systems of this overall type may be seen, for example, in WO00/74437, EP0888031, and U.S. Pat. No. 6,366,678.

SUMMARY OF THE INVENTION

In a first aspect, the invention relates to a microphone assembly comprising a housing, a microphone element within the housing, a base element, contacting elements, a removable element, and connecting means. The housing is configured such that it may be opened and re-closed. The base element is positioned inside the housing and comprises one or more first electrical conductors. The base element comprises one or more first conducting surface parts connected to one or more of the first conductors. The contacting elements facilitate electrical contact between one or more of the first conductors and one or more conductors positioned outside the housing. The removable element is positioned within the housing and comprises one or more second electrically conductive surface parts. The connecting means provides an easily breakable/removable electrical connection between a first surface part and a second surface part.

In this respect, the assembly may be for use in hearing aids (CIC, ITC, BTE or the like) as well as in in-the-ear monitors, mobile telephones or the like.

Generally, the microphone element is adapted to receive sound and provide a corresponding electric signal. This element may be based on any suitable technology, such as moving armature, moving coil, or any other suitable technology. A particularly interesting type of microphone element is a miniature electret microphone for such assemblies, such as a miniature electro acoustic transducer occupying a volume of less than 100 $mm^3$. For different types of applications, smaller transducers may be desired, such as for hearing aid applications, in ear monitors, and the like, transducers occupying less than 30 $mm^3$ are highly desirable, and for headsets and other types of portable communication devices, any intermediate volume may be usable depending on the requirements to the transducer.

In this context, the housing is adapted to be non-destructively opened to gain access to element(s) therein and to be re-sealed or closed again.

Preferably, the base element is fixed inside the housing, such as to the housing itself, but a floating or non-fixed embodiment may also be foreseen. Naturally, the base element may have a part extending outside the housing as long as the first conducting surface parts are positioned within the housing. Also, in this situation, the base element may comprise the contacting elements and/or the one or more conductors outside the housing.

Contacting elements are normally provided in microphone assemblies to transport electric signals from within the housing to outside the housing and/or vice versa, as such housings normally are sealed in order to obtain a suitable sound detection quality. Such sealing may require the use of particular types of contacting elements, such as contacting elements which are sound proof or sealed. In this respect, the conductors positioned outside the housing may be wires attached to the housing, solder bumps or the like attached to the housing, or other conducting elements with electrical connection to inside the housing.

The removable element would normally comprise an electrical circuit, such as an integrated circuit, and as will be described further below, this element may have one or more of a large variety of functions.

In the present invention, an easily breakable/removable electrical connection is a connection which is broken without breaking the base element or the removable element, and in particular without breaking or destroying the first and second surface parts.

A large number of manners of providing this type of connection exist, such as the use of a weak conducting glue, which will break or disengage one of the first and second surface between which it provides a connection, before breaking one of these surfaces or the base element or removable element. A glue of this type may, for example, be Protavic CM 326. The maximum strength of this adhesive—or a total adhesive connection if multiple adhesives are used—is in the order of 1N for an adhesive area (of e.g. a removable element with a total area of about 2 $mm^2$) of about 0.3 $mm^2$.

In a particularly interesting embodiment, the connecting means comprise resilient means for providing a resilient, solderless electrical contact between the first and second surface parts. In this respect, the solderless contact is a non-adhesive contact. One manner of providing a contact of this type is to provide an electrically conducting spring between the first and second surfaces. Removal of the biasing of the spring and thereby disengaging the spring and the surfaces will not harm the surfaces at all.

Another manner would be to provide an anisotropically conductive tape, such as a tape having therein conducting balls extending through the thickness of the tape but not contacting the other balls. In this manner, a number of through going (but limited in the plane of the tape) conductors are provided.

Another manner would be to have the resilient means comprise an element with anisotropic conductivity—such as a so-called zebra element. It is preferable that this element is shaped so that none of its electrically conductive layers has contact with more than one of the first surface parts and one of the second surface parts at a time.

Possible materials to be used for the rubber members of a zebra rubber element with anisotropic conductivity include polybutadiene, natural rubber, polyisoprene, styrene-butadiene copolymer rubber (SBR), butadiene-acrylonitrile copolymer rubber (NBR), ethylene-propylene nonconjugated diene copolymer (EPDM), ethylene-propylene copolymer (EPM), polyurethane-polyester-based rubber, chloroprene rubber, epichlorohydrin rubber and silicone rubber. However, considering its electrical properties and weather resistance, silicone rubber is the most preferable.

It is preferable that the electrically conductive layers of a rubber element with anisotropic conductivity comprise, per 100 weight parts of rubber component, 1-400 weight parts, more preferably 100-300 weight parts, of at least one electrically conductive powder selected from the group consisting of platinum, gold, silver, nickel, cobalt, copper, tin, aluminium and palladium metal powder; an alloy powder containing solder; a conductive powder of organic polymer powder that has been coated with a metal; and a conductive powder of inorganic powder that has been coated with a metal. It is also preferable that the electrically conductive layers of the rubber element with anisotropic conductivity comprise 10-150 weight parts carbon powder, more preferably 40-100 weight parts, per 100 weight parts rubber component. Good conductivity is not attained, when the added amount of electrically conductive powder or carbon powder is below these ranges. When the added amount of electrically conductive powder or carbon powder is above these ranges, the conductivity hardly increases, and the formability and the compression resilience of the rubber connector are inhibited.

It is preferable that the zebra-type rubber connector with anisotropic conductivity is elastically compressible and can be installed by area-contacting it with, for example, the surface parts of the base element and the removable element. When the rubber connector is elastically compressible, it can elastically deform in an appropriate manner to be compressed between the base element and the removable element. Thus, the rubber connector can establish secure a real contact between the two sets of surfaces. As a result, this increases the reliability of the electric connection.

It is preferable that the rubber members have a compression resilience of 30-80 measured with Method A in JIS K6301. If the compression resilience is below this range, the elastic deformation of the rubber connector becomes large, and the conductivity becomes pressure sensitive, so that the electric contact resistance to the surface parts becomes unstable. If the compression resilience is above this range, the elastic deformation of the rubber connector becomes small, so that the reliability of the electric contact with the surface parts decreases. Method A in JIS K6301 for measurement of the compression resilience is performed as follows: A sample piece of the size specified in JIS K6301 is prepared from the material to be tested. An A-type spring-based hardness meter according to JIS K6301 is used as the measuring instrument. Method A in JIS K6301 is in conformity with Type A in ASTM D2240.

In general, it is preferred that the housing has a removable part which may be attached to the main housing, subsequently disengaged there from and then re-attached to the main housing. This engagement may be obtained using a clicking action, a thread, welding, soldering, magnets and magnetic materials, hinges or the like. Another manner would be to fix the removable part to the main housing by deforming a part of the main housing or the removable part in order to fix these parts to each other. In one situation, the removable part is received within deformable parts of the main housing, which removable parts are then deformed to engage and fix the removable part in the desired position.

In this respect, it is preferred that the removable element is engageable and removable through the opening created when the removable part has been removed. Thus, the size and dimensions of the opening of the housing is/are larger than that/those of the removable element.

In addition, it is preferred, when the connection between the first and second surface parts is solderless and resilient, that the removable element and base element are positioned so that the removable part, when attached to the housing, biases the removable element toward the resilient means and the base element. In this manner, removal of the removable part will facilitate easy removal of the removable element, and the providing of the biasing force is automatically provided when re-engaging the housing and the removable part.

Preferably, the positions of the individual first and second surface parts to be interconnected are such that these surface parts overlap in a projection on a plane of the base element and perpendicular to a direction of a biasing force provided by the removable part, if this embodiment is used.

As mentioned above, the removable element may be any type of element, typically comprising an electrical circuit. A large number of circuit types and functionalities may be contemplated for use in or together with a microphone. Preferably, the removable element is selected from the group consisting of a sensor, an amplifier, a storage, a processor, a DSP, and/or means for receiving instructions for the microphone assembly to operate in accordance with (such as for re-programming of an internal processor).

In this connection, a sensor may e.g. be one or more of (i) a Giant Magnetic Resistor adapted to e.g. detect a magnetic field (for use e.g. as a switch operable using e.g. a magnet), (ii) a pulse sensor, (iii) a telecoil, (iv) a skin sensor (which may be based on any principle from capacitive to resistive) useable in e.g. microphones positioned on the outside of e.g. Hearing Aids, (v) a temperature sensor (for instance to compensate for certain behaviors of the system dependent on the temperature), (vi) a humidity sensor to compensate the microphone for humidity changes or to compensate for humidity changes in the whole system, (vii) a calibration microphone (may be, for example, a noisy silicon microphone used just to calibrate the main microphone), (viii) a vibration/motion sensor or accelerometer to see if the user is moving/walking so as to be able to, for example, adapt the software to the movement (in one situation, a shock sensor could be used for adapting an amplification. An example is that it is desired that the volume of a hearing aid is reduced during a traffic accident in that airbags provide a very high sound pressure), (ix) a capacitive sensor which could be used as a touch sensor through which the hearing aid or microphone assembly may alter e.g. a manner of operation (turning volume up/down—switching between modes, such as the use or not of a telecoil), or (x) a flow sensor or sensors (already known as a system) to detect and/or compensate the output signal from the effect of wind noise.

Also, a storage may be of any type, such as RAM, ROM, PROM, EPROM, EEPROM, Flash, or the like, and may be used for storing instructions for a processor, calibration data for a processor, built-in or connected to the microphone assembly, ID of the microphone assembly or microphone assembly type, or the like.

In certain situations, the function of the removable element is to perform a preprocessing of the signal from the microphone element before outputting the pre-processed signal from the housing. In that situation, it is desired that the assembly further comprises one or more third electrical conductor(s) connecting an output of the microphone element to one or more of the first surface parts. In that manner, the signal from the microphone element is fed to the removable element, is pre-processed, and may then be fed to the first conductors and to outside the housing via the contacting elements.

BRIEF DESCRIPTION OF THE DRAWINGS

In the following, the preferred embodiments of the invention will be described with reference to the drawings, wherein:

FIG. 5 illustrates another manner of fastening the removable part;

FIG. 6 illustrates an embodiment incorporating a magnetic sensor and enhancing antennas; and FIG. 7 illustrates an embodiment incorporating two magnetic sensors.

Figure 1:
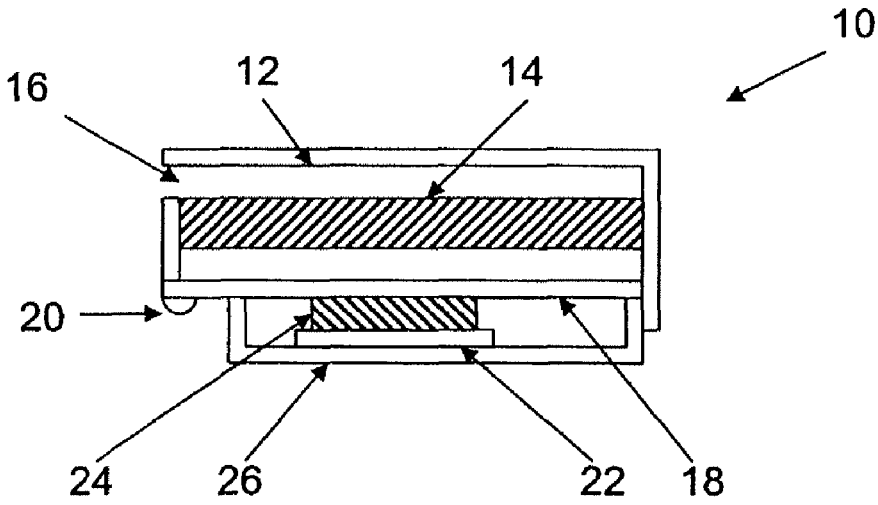
FIG. 1 illustrates a cross-section of a preferred embodiment of a microphone assembly.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

DETAILED DESCRIPTION OF THE INVENTION

In FIG. 1, a microphone assembly 10 has a housing 12 in which a microphone element 14, such as an electret microphone element, is positioned to receive sound entering the housing 12 via a sound inlet 16. A base element 18 (also shown in FIG. 2) is positioned inside, and is fixed to, the housing 12. As may be seen from FIG. 2, the base element 18 comprises therein or thereon conductors 21 and conducting surfaces 23 through which the conductors 21 may be connected to external elements as will be clear from the below description.

One or more of the conductors 21 is/are electrically connected to solder bumps 20 positioned on the base element 18 on the outer side of the housing 12 in order to obtain electrical connection from outside the housing 12 to the surfaces 23 of the base element 18. Alternatively, the base element 18 may be comprised fully within the housing, and connecting means are provided through the housing walls to solder bumps 20 provided outside the housing. This is known to the skilled person.

Figure 2:
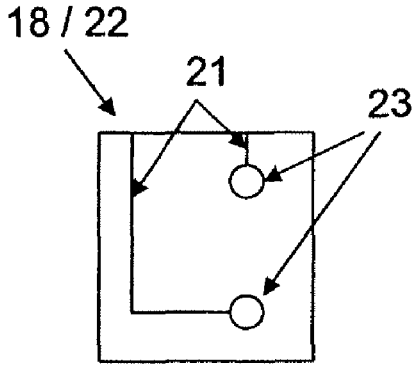
FIG. 2 illustrates conductors and conducting surfaces of a base element of the embodiment of FIG. 1.

Inside the housing 12 is also a chip 22 having outer surface parts 23, which are also illustrated by FIG. 2, and may internally have a number of electrical conductors and circuits to which electrical contact may be obtained via the surfaces 23.

Electrical connection between the surface parts 23 of the base element 18 and the chip 22 is provided via an element 24 which may take any of a number of shapes. The overall function of the element 24 is to provide the electrical contact while allowing easy breaking of this contact.

Preferably, the positions of the surface parts 23 of the base element 18 and the chip 22 are identical (positioned in at least overlapping positions when projected to a plane of the base element 18), whereby the element 24 may simply provide electrical connections across its width.

Figure 3:
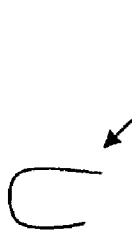
FIG. 3 illustrates a first embodiment of a connecting element for use in the embodiment of FIG. 1.

One type of connecting element 24 is seen in FIG. 3 and is simply a spring adapted to connect a surface part 23 of the base element 18 and a corresponding (positioned adjacently) surface part 23 of the chip 22.

Figure 4:
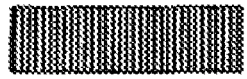
FIG. 4 illustrates a second embodiment of a connecting element for use in the embodiment of FIG. 1.

A particularly interesting connecting element 24, however, is seen in FIG. 4 and is one with anisotropic conductivity, commonly called a Zebra element, which provides intermittent layers of conducting an non-conducting material, whereby a suitably dimensioned and directed element of this type will connect overlapping surface parts 23 (of the base element 18 and the chip 22) while not connecting or shorting surface parts 23 of the base element 18, surface parts 23 of the chip and/or pairs of a surface part 23 of the base element 18 and a surface part 23 of the chip 22 between which electrical connection is not desired.

In addition, both this zebra element 24 and the spring 24 is non-adhesive, so that the chip 22 and the base element 18 may be easily separated from each other or the element 24.

An alternative to the zebra element and the spring is a weak adhesive 24, conductive glue, which may be applied to each surface part 23 of one or both of the base element 18 and the chip 22, after which the elements are easily connected so that the glue forms the connections 24. This adhesive should be so weakly adhesive that breaking away the chip 22 from the base element 18 should not break the base element 18 or the chip 22, nor destroy or detach the surface parts 23 there from.

A glue of this type may be Protavic CM 326. If the strength of this glue is not sufficient, an additional glue, such as Heraeus PD 955M or Loctite 3421 (e.g., applied at two opposite edge portions) may be used. Presently, it is preferred that a 0.3 $mm^2$ chip is attached with a force of about 1N or less.

Reverting now back to FIG. 1, it is seen that the housing 12 has a removable part 26 which is positioned adjacently to the chip 22 and which has dimensions sufficient for the chip 22 to be removed from the housing 12. Thus, removing the removable part 26 provides access to the chip 22, which may be removed, positioned or replaced, if desired.

The removable part 26 may be attached to and detached from the housing 12 by any suitable means, such as a hinge, a lock, a thread, welding/soldering, press fitting, click action, magnetic forces, electromagnetic forces, or the like. In addition, a glue, such as a PU adhesive or a soft two-component epoxy may be used.

Another manner of fixing the removable part 26 to the main housing 12 may be seen in FIG. 5, wherein the removable element 26 is a plane element receivable within the housing 12, which has extending elements 30 which may, subsequent to the positioning of the removable part 26, be deformed so as to keep the removable part 26 in place. Removing the part 26 requires deforming the parts 30 back to (in the figure) at least an upward direction so that the removable part 26 may be removed from within the housing 12.

As to the actual operation and function of the chip 22, numerous possibilities exist. In one example, the chip 22 is a sensor, the output of which is desired outside the housing 12. A sensor of this type is described above. Wireless signals may be related to audio for the user to hear or for the hearing aid to operate in accordance to (programming of a processor or signal processing, e.g.). In general, the element 22 may share power lines and feeds with the microphone element but need otherwise not have any interaction therewith.

In another example, the chip 22 is adapted to receive the signals from the microphone element 14 and pre-process these signals before outputting these from the housing 12. Thus, the signals will be fed from the microphone element 14 to the conductors of the base element, such as also by using a zebra element, and to the chip 22, and back to the base element for outputting to the solder bumps 20.

In this respect, a number of additional improvements present themselves such as the providing of an opening through the base element 18 in order to also use space next to the elements 22 and 24 for, as an example, a back volume of the microphone element 14. This may increase the sound quality of the sound detection but may, on the other hand, require a better acoustical seal between the housing 12 and the removable part 26.

In addition, the space around the element 22 may be used for other purposes or elements, such as an R/C combination aiming at improving the EMI performance of the microphone assembly.

Also, in order to reduce the overall thickness of the assembly of the elements 18, 22, and 24, the base element 18 may be provided with an area of a reduced thickness, such as a hole or indentation, which may be able to receive the element 24 and possibly all of or part of the element 22 or may be able to accommodate even thicker elements 22.

A particularly interesting embodiment is one where the element 22 is a GMR for use in detecting a magnetic field, such as for use as a signal for controlling an operation of the assembly. One use may be the switching on/off of the user of a telecoil, and/or the altering of a volume of the assembly. Naturally, many other uses of an input of this type may be used. Actually, using a sensor of this type may render the use of a simple magnet as a remote control possible.

An embodiment using a GMR is illustrated in FIG. 6, wherein the GMR 22 is positioned between two strips 28 of soft magnetic material which will act as antennas and thereby enhance or amplify the magnetic field sensed. The strips 28 may be fastened using Loctite 3421 or the like and be, for example, square or round with a 0.3 mm width and a length of e.g. 1.6 mm. In addition or alternatively, part of the main housing 12 or the removable part 16 may be made of a magnetic material.

In another embodiment, illustrated in FIG. 7, two GMR's are positioned side by side, but rotated in relation to each other in that GMR's are quite direction sensitive. Thus, in this manner, a better overall sensitivity is obtained.

Each of these embodiments and obvious variations thereof is contemplated as falling within the spirit and scope of the claimed invention, which is set forth in the following claims.

The invention claimed is:

1. A microphone assembly comprising:

a housing that can be opened and re-closed;

a microphone element positioned in the housing;

a base element positioned inside the housing and comprising one or more first electrical conductors, the base element comprising one or more first conducting surface parts connected to one or more of the first conductors;

contacting elements facilitating electrical contact between one or more of the first conductors and one or more conductors positioned outside the housing;

a removable element positioned within the housing and comprising one or more second electrically conductive surface parts; and connecting means for providing an easily breakable/removable electrical connection between a first surface part and a second surface part.

2. An assembly according to claim 1, wherein the connecting means comprise resilient means for providing a resilient, solderless electrical contact between the first and second surface parts.

3. An assembly according to claim 2, wherein the resilient means comprise an element with anisotropic conductivity.

4. An assembly according to claim 2, wherein the housing has a removable part which may be attached to the housing, subsequently disengaged there from, and then re-attached to the housing and wherein the removable element and base element are positioned so that the removable part, when attached to the housing, biases the removable element toward the resilient means and the base element.

5. An assembly according to claim 1, wherein the housing has a removable part which may be attached to the housing, subsequently disengaged there from, and then re-attached to the housing.

6. An assembly according to claim 1, further comprising one or more third electrical conductor(s) connecting an output of the microphone element to one or more of the first surface parts.

7. An assembly according to claim 1, wherein the removable element is selected from the group consisting of: a sensor, an amplifier, a storage, a processor, a DSP, and means for receiving instructions.

* * * * *